United States Patent [19]

Pieddeloup

[11] Patent Number: 4,732,020

[45] Date of Patent: Mar. 22, 1988

[54] BOLT WITH INTERCHANGEABLE CODED INFORMATIONS

[76] Inventor: Georges R. Pieddeloup, 4, rue de Meautry, F 94500 Champiny/Marne, France

[21] Appl. No.: 287

[22] Filed: Jan. 2, 1987

Related U.S. Application Data

[63] Continuation-in-part of Ser. No. 640,988, Aug. 15, 1984, abandoned.

[30] Foreign Application Priority Data

Aug. 16, 1983 [FR] France ..... 83 13322

[51] Int. Cl.[4] ..... E05B 37/02

[52] U.S. Cl. ..... 70/305; 70/306

[58] Field of Search ..... 70/302, 303 R, 303 A, 70/304, 305, 306

[56] References Cited

U.S. PATENT DOCUMENTS

| | | | |
|---|---|---|---|
| 426,427 | 4/1890 | Bechtl | 70/306 |
| 2,069,572 | 2/1937 | Berggren | 70/305 |
| 2,247,220 | 6/1941 | Conlon | 70/305 |
| 2,289,234 | 7/1942 | Bergren | 70/305 |
| 3,295,342 | 1/1967 | Etter | 70/315 |
| 3,745,798 | 7/1973 | Pieddeloup | 70/315 |
| 3,832,873 | 9/1974 | Barnette | 70/315 |
| 4,011,742 | 3/1977 | Klein | 70/305 |
| 4,048,823 | 9/1977 | Szoua | 70/306 |

*Primary Examiner*—Robert L. Wolfe

*Attorney, Agent, or Firm*—Cushman, Darby & Cushman

[57] ABSTRACT

The invention relates to a lock with interchangeable coded combinations, wherein the code is materialized by notches made in a disc. Reproduction of the exact code controls the disc so that a locking member is not displaced from its unlocking position. Furthermore, a locking member is in unlocking position only if the number of the digits of the code is respected. The invention is particularly applicable to the safeguarding of property.

10 Claims, 11 Drawing Figures

BOLT WITH INTERCHANGEABLE CODED INFORMATIONS

This application is a continuation-in-part of my prior application Ser. No. 640,988, filed Aug. 15, 1984 and now abandoned.

The present invention relates to instruments of the keyless bolt or lock type with interchangeable coded combinations.

In known devices of this type, the search for silent operation in order to escape investigations with the aid of improved listening and recording apparatus, the production of mechanisms tending to equalize the internal mechanical resistances in order to eliminate the possibility of discovery of the identity of the code by means of a dynamometer, and the increase in the mechanical capacities of the devices with a view to obtaining a larger number of combinations in order to increase security, are the reasons for high costs. High costs reduce the fields of application of such devices by reserving them for sales and strong rooms without completely eliminating in the latter the use of systems incorporating keys, which such devices were intended to replace in order to overcome their weaknesses, i.e. losses of keys, taking of fingerprints, the possibility of being copied or picked as well as the existence of only one mechanical combination represented by the key. To overcome these shortcomings, there have been added to these locks with keys a coded barrel system which, when the code is correctly reproduced, makes it possible to actuate an electric motor whose function is to unlock a locking linkage, thus rendering the system even heavier and influencing its cost, while being a complex installation due to the large number of openings to be made in the door to be locked.

By their design, these devices require that all the numbers constituting the combination and composable by means of a dial, be necessarily codifiable mechanically. A complex code thus involves a complex, therefore expensive mechanism. Now, it is known that security is directly linked with the number of possible combinations, a large number of combinations is, due to the increase in the composition time for reproducing the code, or to the limitation of the total time left to the user for composing the code, alone capable of thwarting the discovery of the identity of the code, by the so-called "exhaustion" method, which consists in systematically reproducing all the code combinations which may be made with the mechanism.

Finally, it is ascertained that, due to the high cost, the slowness or the complexity of the manipulation for reproducing the number of the code, to the difficulty in modifying the identity of this code, or to the insufficient quantity of the possible number of combinations, whether they be actuated by means of a graduated dial or by an alpha-numeric dial, of the telephone type, these devices only have applications limited to the solution of specific problems.

The device of this invention provides a keyless combination lock which is particularly reliable as it comprises a large number of digits, and therefore a considerable number of possible combinations without it being necessary to provide a mechanical device capable of physically reproducing all the combinations. This results in a lock which is comparable, even superior from the safety standpoint, to highly sophisticated locks existing at present, without presenting the complexity thereof, therefore of very low cost. Furthermore, its design enables the coded combination to be modified very simply and quickly.

To this end, the invention relates to a lock with interchangeable coded combinations comprising at least two locking members opposing the free passage of a tool for actuating a lock mechanism in all their positions, except one obtained after having reproduced the coded combination by means of a device for mechanically driving said members. According to one of the principal features of the invention, the drive device comprises, on a fixed shaft on which said locking members are mounted for braked rotation, an angularly mobile assembly bearing a first pawl cooperating with a toothing fast with the first locking member to drive it in unidirectional rotation about said shaft by a constant angular distance, independent of the angular amplitude of the movement of the assembly resulting from the reproduction of the coded combination. The assembly also includes a second pawl cooperating on the one hand with the second locking member and on the other hand with a notched code disc removably mounted for braked rotation on said shaft to drive the notched disc in unidirectional rotation by an angular distance equal to the amplitude of the angular displacement of the mobile assembly resulting from reproduction of the coded combinations and to drive said second member in rotation when the pawl bears on a non-notched part of said disc.

Said notched disc is advantageously made of a material in which notches can easily be made at least on its periphery which is provided with a marking dividing it into a plurality of equal sectors whose width corresponds to the width of the notches to be made in spaced relation from a reference notch. In this respect, it will be noted that the number of divisions of the said plurality constitutes a limit to the actual combination capacity of the lock as will be explained in greater detail with reference to the embodiment described hereinafter. This number will have been chosen exemplary to be equal to 60, and this for reasons of dimensions of the lock, but a disc with a different number of divisions would not depart from the scope of the invention.

In a particular embodiment of the invention, the notched disc is coupled to one end of a spindle rotating in a braked manner inside the fixed shaft. On the other end of the spindle is a maneuvering knob for rotating the spindle to lock the mechanism by jamming the combination and returning the locking members and notched disc into initial positions.

In addition, the notched disc has a finger projecting from its side parallel to its axis cooperating with one end of a slot in the second locking member and a similar finger on the first locking member for mutual return thereof into initial positions by means of the maneuvering knob. Furthermore, the first locking member is, in its initial locking position, remote from its unlocking position by an angular distance, determined by the location of its finger, equal to the said constant angular distance multiplied by the number of digits constituting the coded combination. The second member is, in its initial position, in unlocking position. It will also be noted in this respect that the angular distance separating the initial position from the final position of the second locking member is a factor which also limits the actual combination capacity of the lock in that it determines the number of digits of the code and therefore the number of manipulations of the mechanical drive device. As will be seen hereinafter, by simply positioning a stop e.g. a finger, at predetermined locations, all else being equal, the number of digits which constitute the code may be determined. Different types of locks maneuverable by means of a combination with different numbers of digits (from 6 to 14 or 16 for example) may thus be manufactured in a simple manner. It is the combination of the number of divisions of the notchable disc and of the angular distance separating the initial position from the unlocking position of the first member which constitutes the limit to the choice of the code, knowing that the sum of the digit numbers constituting the code cannot be greater than the said number of divisions.

According to another feature of the invention, said mobile arrangement is coupled to a drive shaft for controlling its revolution, which shaft at one end is capable of having attached thereto, in a removable manner, an alpha-numeric dial for driving the assembly to compose the code. It should be mentioned in this respect that the coupling of the dial to the drive shaft is advantageously disengageable when the resistant torque offered by the mechanical devices driven by the dial is greater than a predetermined value when, for example, having exceeded the limit of combination capacity of the lock, the different mobile pieces are stopped at the end of a stroke.

In a preferred embodiment, in order in particular to avoid any striking noise allowing detection by ear which may lead to identification of the code, the mobile assembly is constituted by a pinion mounted to rotate on said fixed shaft meshing with a pinion on said drive shaft and provided with a finger parallel to said fixed shaft for driving a web, rotating on said fixed shaft, which web bears a pivot for said pawls, the said finger passing through a slot in said web and constituting a cam for lifting or lowering the pawls acting against the locking members.

The invention will be more readily understood on reading the following description with reference to the accompanying drawings in which.

Figure 1:
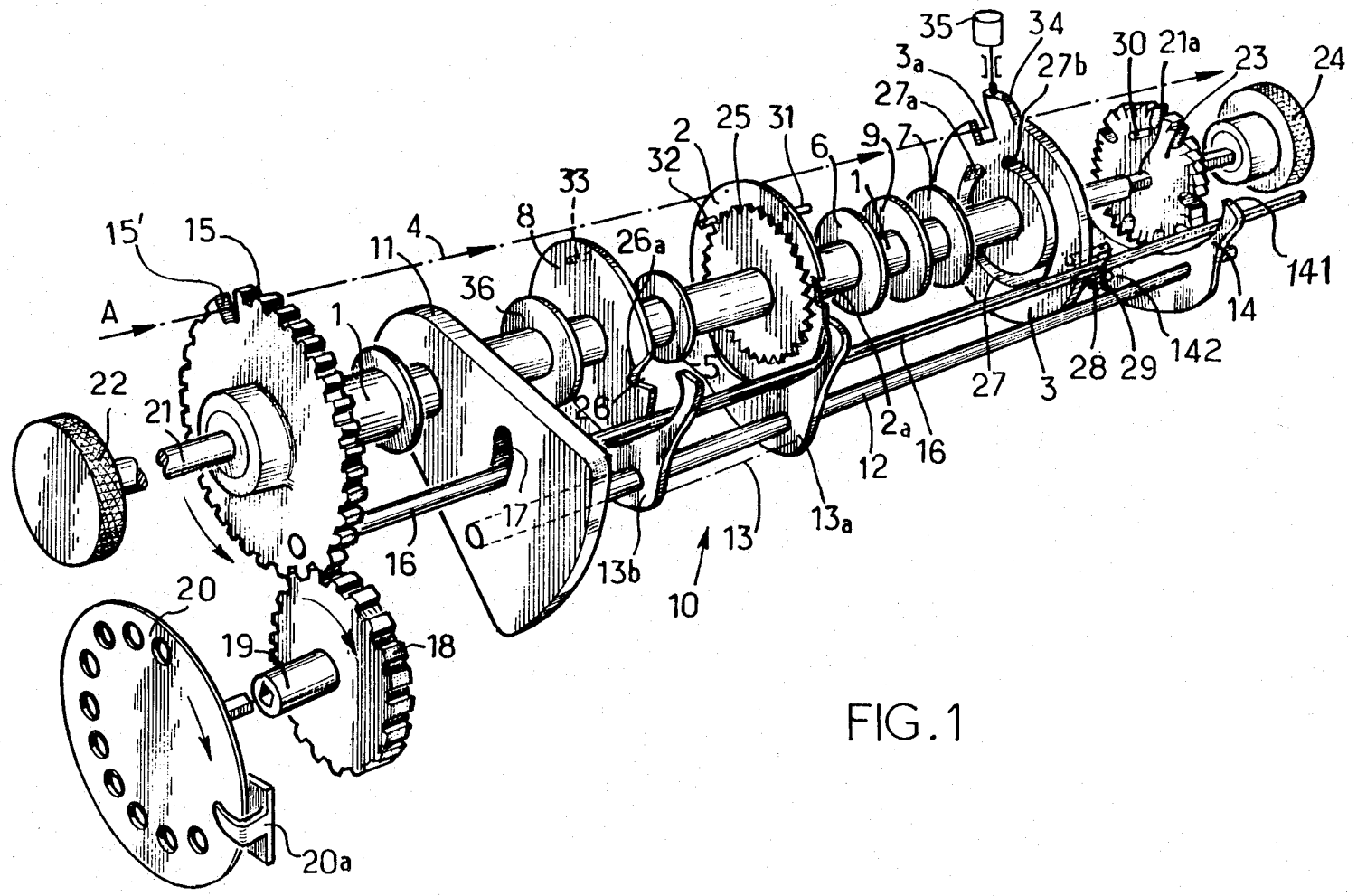
FIG. 1 is an exploded schematic view of the lock according to this invention.

FIGS. *5a–5c, 6a, 6b, 7a* and *7b* are fragmentary sectional views taken at various locations along the fixed shaft, shown in FIG. 1, showing the working of the lock.

Referring now to the drawings, there is shown a fixed main shaft or rod 1 on which are mounted, for braked rotation thereon, two disc-shaped locking members 2 and 3 which interfere with the translational movement, along the path 4 (FIG. 1—marked in chain-dotted lines) parallel to the shaft 1, of a conventional lock-operating tool for actuating a lock mechanism. This tool may, for example, be a rotatable rod which may be moved in translation along the path 4 in the direction of arrows A for it to disengagingly couple with a conventional lock mechanism (not shown) on the right-hand side of FIG. 1, and in rotation, once a disengageable connection is made with the lock mechanism, to engage or disengage a sliding bolt of the latter with or from a keeper. The control in translation and in rotation of this tool may be effected on the left-hand side of FIG. 1 by a rotatable push button, knob or handle or any other like element on the end of the tool.

Figure 3:
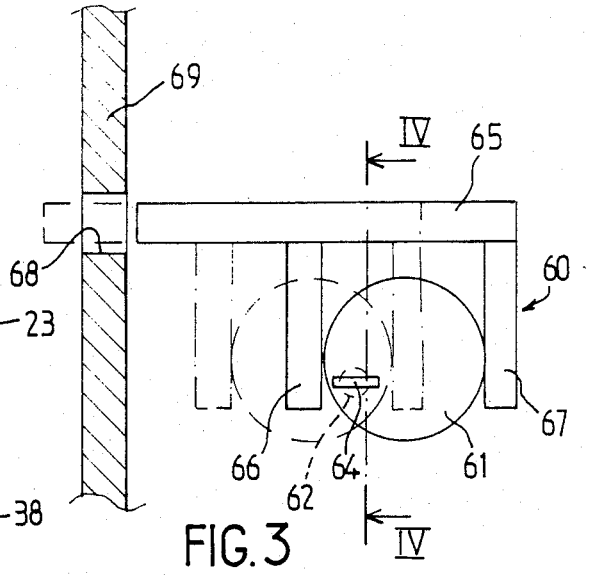
FIG. 3 is a fragmentary sectional view taken on line III—III of FIG. 4 and illustrating operation of a sliding bolt lock mechanism when the lock shown in FIG. 1 is unlocked.
Figure 4:
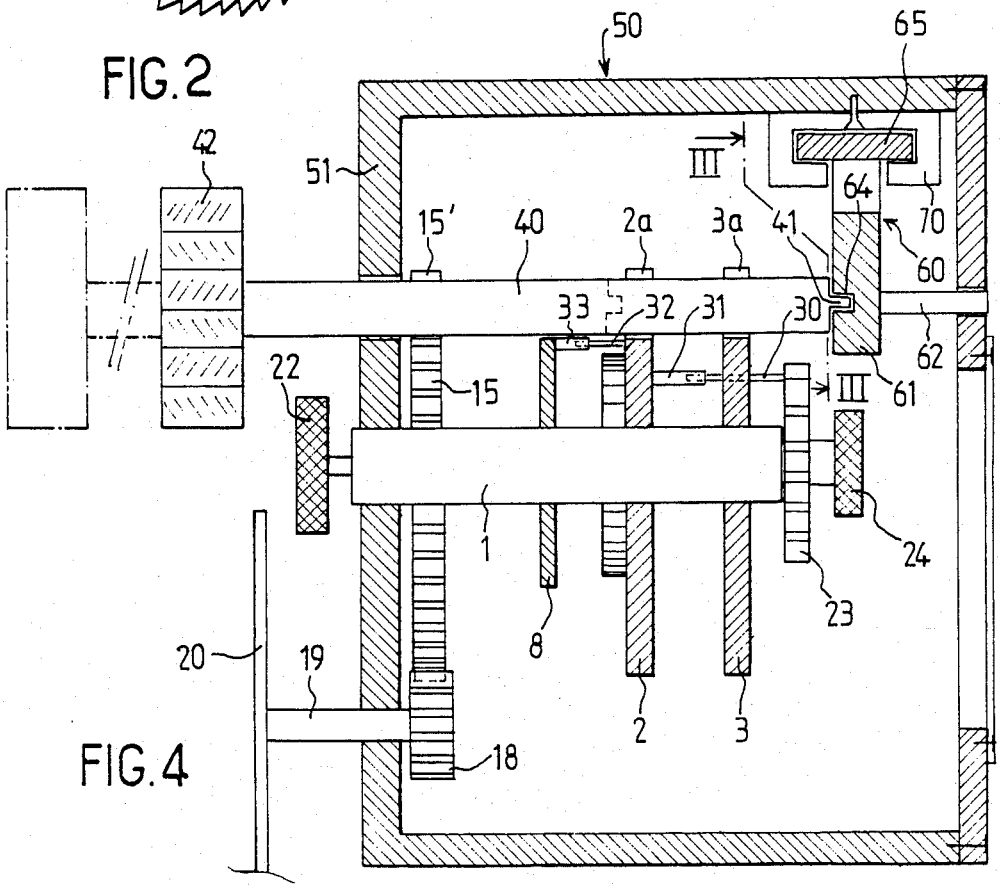
FIG. 4 is a longitudinal view, partly in section and partly diagrammatic, illustrating the lock embodying this invention mounted in a housing in association with a sliding bolt lock mechanism.

An exemplary lock mechanism 60 is shown in FIGS. 3 and 4 and may comprise a bolt 65 sliding in a guide 70 and engageable in a keeper 68 in a fixed upright 69, e.g. a door frame. The bolt 65 is actuated by a rotatable cam 61 mounted between two lateral projections 66, 67 on the bolt. The cam 61 is eccentrically mounted on an axle 62 journalled in a wall of a housing 50 (which may be located in a door) so that rotation of the cam slides the bolt 65. The cam 61 is rotated by a rod-like tool 40 insertable through an opening in the wall 51 of the housing 50 and rotatable about the axis of the axle 62. At one end the tool 40 is detachably connectable to the cam 61, as by a tongue 41 and slot 64 connection. On the other end of the tool 40 is an operating knob 42. Rotation of the tool 40 rotates the cam 61 in one direction to move the bolt 65 from an unlocked position (shown in sold lines in FIG. 3) to a locked position (shown in dotted lines), and vice versa.

Translation of the tool 40 will be allowed to reach and lock or unlock the lock mechanism 60 only if the position of the discs 2 and 3 is such that the respective peripheral notches 2*a* and 3*a* lie on or are aligned with the translational path 4 of the tool. In all other cases, the tool 40 will abut against disc 2 or disc 3 without being able to reach the lock mechanism 60 to lock or unlock it. A coupling (not shown) will have been provided, in known manner, between the knob 42 and the tool 40 which yields beyond a certain threshold of thrust (telescopic engagement of one in the other with interposed spring, for example) so as to limit to an acceptable value, without damage to the discs 2, 3, the force to which they would be subjected by the tool in their locking positions.

Disc 2 and disc 3 are braked in rotation on the shaft 1 by friction against two washers 5 and 6 abutting opposite sides of disc 2 and against a washer 7 abutting disc 3. These washers will preferably be made of an elastomer reinforced with magnetic powder and abut on webs fixed on shaft 1, web 8 for washer 5 and a web 9 for washers 6 and 7. The webs 8 and 9 are force-fitted on the non-rotatable shaft 1. To render FIG. 1 clearer, this stack is shown with discs, washers and webs separate, but these elements are in fact adjacent.

Rotation of discs 2 and 3 is controlled by an assembly 10 angularly revolvable or oscillatable about the fixed shaft 1. This assembly is constituted by a web or sectorial-shaped element 11 extending at right angles from the shaft 1, rotatable thereabout and carrying a spindle or pivot pin 12 in spaced parallel relation to the shaft and capable, therefore, of oscillating or revolving about shaft 1. On this pivot pin 12 are articulated two pawls 13 and 14, the pawl 13 being shown here in the form of two pawls 13*a* and 13*b* fast with each other, as shown by the chain-dotted lines joining them, due to the spaced-apart representation of members 8 and 2 with which the pawl 13 cooperates in their real position. As shown in FIGS. *5a–5c, 6a* and *6b*, and *7a* and *7b*, the pawls 13*a* and 13*b* have tooth ends 131*a* and 131*b*, respectively, and weighted or ballast ends 132*a* and 132*b*, respectively, while the pawl 14 has a tooth end 141 and a ballast end 142. Instead of the ballast ends, conventional return members, e.g. springs (not shown) may be used to urge the tooth ends of the pawls 13 and 14 toward shaft 1 in a well known manner. The mobile assembly 10 also comprises a pinion or toothed wheel 15 mounted to rotate on shaft 1 and carrying a finger or rod 16 parallel to shaft 1 which passes through a slot 17 in the web 11 and on which, in their position shown in FIGS. 1, 5a–5c, 7a and 7b, the pawls 13 and 14 abut under the urging effect of their respective return members or ballast ends. If of large diameter, pinion 15 also has a notch 15' therein alignable with the path A.

Pinion 15 meshes with a pinion 18 which is fitted on a control or driving shaft 19 of which the end outside the housing 50 in which the lock is mounted comprises means for its detachable coupling with a digital or alpha-numeric dial 20 of the telephone dial type. Conventionally such a dial 20 has a number, e.g. 10, of finger receiving holes numbered respectively from 1 to 10, and is rotatable by hand from a starting position to a finger stop 20a and returned to its starting position by a spring (not shown) or by hand. The detachable coupling means, symbolized here by a driving square and socket, will preferably comprise any conventional system of disengagement allowing free rotation of the dial 20 when the resistant torque offered by the mobile assembly 10 is greater than a predetermined value (for example when the capacity of the lock has been attained or when at least certain of the elements thereof have come into abutment or engagement).

Furthermore, the shaft 1 is hollow and is traversed by an inner rotatable spindle 21 having at its end on the outside of the housing 50 an operating knob 22 which may be removable. At its other end the spindle has a non-circular part 21a for receiving a notchable and notched code disc 23, shown best in FIG. 2. This disc 23 is fitted on the spindle to rotate therewith and is removably held thereon by a knurled nut 24. Preferably the spindle 21 is braked in any known manner against rotation in the shaft 1.

Figure 7A:
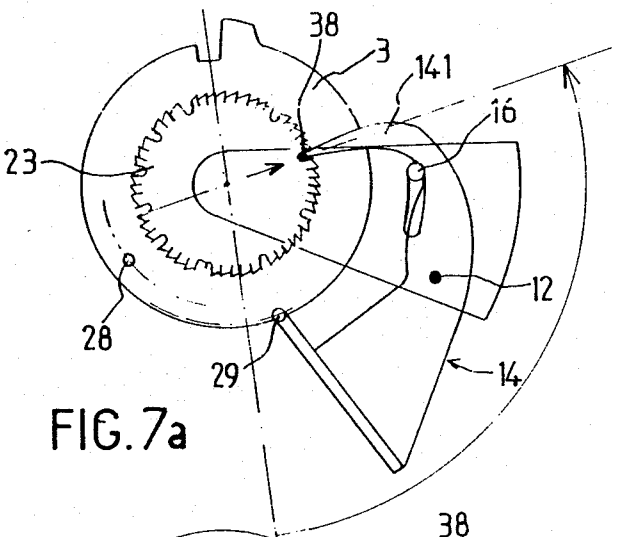
Figure 7B:
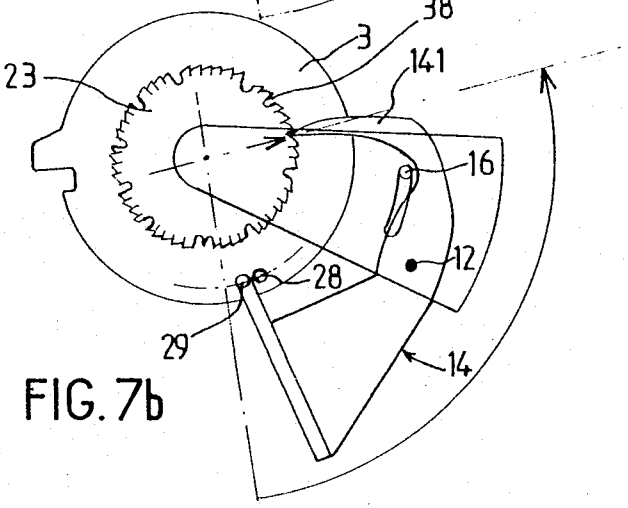
Figure 5C:
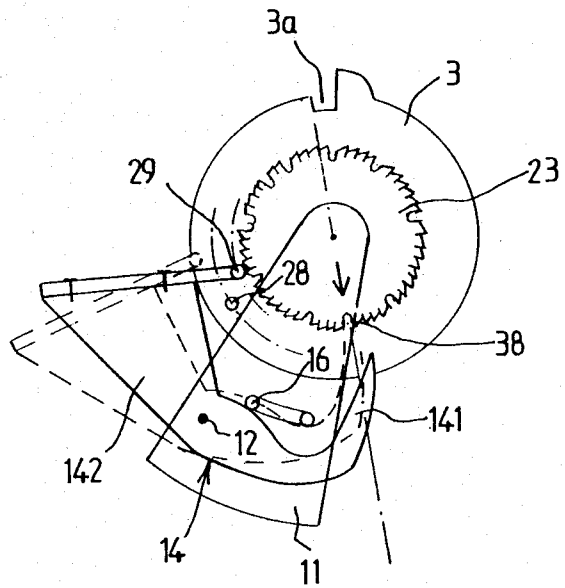

The disc 2 is provided on one of its faces with a toothing or teeth 25 which may cooperate with the pawl 13 while the disc 8 has a notch 26 in which the pawl 13 (part 13b thereof) may drop. One edge 26a of the notch 26 is shaped as a cam surface ensuring lift of the pawl 13 when the latter runs therealong. Furthermore, the disc 3 has a circular slot 27, with opposite ends 27a and 27b, and a stop finger 28 projecting from its side parallel to the axis of shaft 1 and facing the pawl 14. On its end 142 the pawl 14 has a stop finger 29 facing the disc 3. The relative arrangement of the fingers 28 and 29 is such that, when the tooth end 141 of the pawl 14 is remote from the edge of disc 23 by engagement of the rod 16 with pawl 14, the finger 29 is located between the shaft 1 and the arcuate path of finger 28, as shown in FIG. 5c. When the tooth end of the pawl 14 cooperates with the edge of the disc 23 in a non-notched zone, the finger 29 is located in the arcuate path of finger 28 as shown in FIG. 7b, and the revolution of pawl 14 with rod 12 about the shaft 1 brings about a corresponding rotation of disc 3. Finally, when the tooth end 141 of the pawl 14 is housed in a notch in the disc 23, the finger 29 is located outside the arcuate path of the finger 28 as shown in FIG. 7a.

In addition, it will be noted that the disc 23 is provided with a finger 30 facing the slot 27 to penetrate therein and cooperate with a finger 31 on one face of the disc 2. On its other face, the disc 2 has a finger 32 facing the fixed disc 8 which has, in register, a finger 33 preventing rotation of the disc 2 when the finger 32 encounters finger 33.

Finally, although an optional feature, the disc 3 advantageously may possess a cam surface 34 which cooperates with a display and/or alarm device 35, and oscillation of the web 11 of the mobile assembly 10 is braked by means of a magnetic washer 36 abutting on web 11 and on the fixed web 8.

Figure 2:
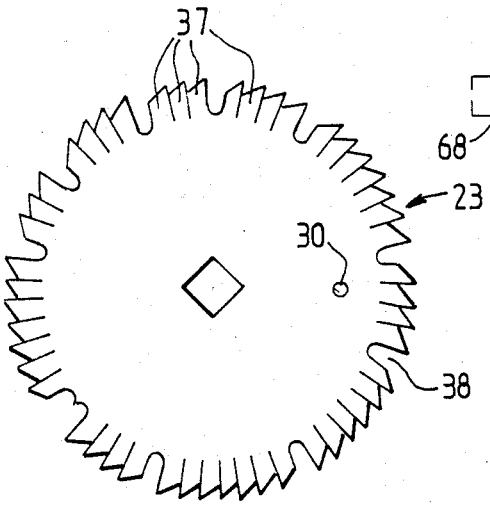
FIG. 2 illustrates an embodiment of the notched code disc employed in the invention.

Coding of the lock according to the invention consists in notching the disc 23 and in fastening it on the end 21a of the spindle 21 by the knurled nut 24. The disc 23, as shown in FIG. 2, is constituted by a circular plate of a material whose edge is easy to notch by means of pliers. This disc has a plurality of equal divisions 37 on its periphery made by appropriate markings or an adhesive bearing printed divisions. In the exemplary case of FIG. 2, these divisions are sixty in number. The disc 23 also has a reference notch 38.

The starting or initial position of the lock is such that the finger 32 of the disc 2 is in abutment with the finger 33 of the web 8, while finger 30 of the disc 23 is in contact with finger 31 of disc 2 and in contact with the end 27a of the slot 27 of disc 3. In this position, the reference notch 38 lies opposite the tooth of pawl 14. To bring the lock to this initial or starting position, the knob 22 is rotated clockwise to bring finger 30 on disc 23 into contact with the end 27a of the slot 27 in the disc 3 and into abutment with the finger 31 on disc 2. Continued rotating of knob 22 thus rotates disc 2 until its finger 32 contacts finger 33 on the fixed web 8.

In this initial position, the notch 2a of the locking disc 2 is in a position (FIGS. 1 and 5b) remote from its unlocking position, i.e. in the path 4, by an angular distance equal to a certain number of teeth of the toothing 25, this number corresponding to the number of manipulations, i.e. to the number of digits in the code, which must be made to bring the notch into its unlocking position by means of pawl 13. This number is illustrated, for example, to be equal to 10. In order to increase this number, it suffices simply to angularly displace fingers 31 and 32 of the disc 2 towards a position more remote from the notch 2a in anti-clockwise direction and, in order to reduce it, to bring these two fingers angularly closer to the notch in clockwise direction. Different types of the lock may thus be manufactured with a minimum of modifications from one type to the other, especially if the locations of the fingers 31 and 32 on the disc 2 are predetermined.

In this way, returning to the coding, for a lock with a combination of ten digits, ten code notches should be made in the disc 23, each notch being made on a division 37 and with the same width as the latter. The code combination thus obtained will be the sequence of the ten numbers of divisions which separate each code notch clockwise from the preceding notch, starting from reference notch 38, the code notch being included in the number of divisions. The code combination shown in FIG. 2 is therefore written 7 8 5 1 8 4 5 4 5 8. It will be noted that one of the important advantages of the lock of the invention resides in the simplicity of its coding and especially in the simplicity in modifying it. In fact, it suffices to change the disc 23, which is very rapid, the nut 24 being easily accessible from inside the premises, e.g. from the inside of a door on which the lock is installed.

The lock being coded, the combination may be "jammed" by rotating the knob 22 in anti-clockwise direction. During such rotation cooperation of the different fingers 30 and 31 with each other and with the end 27b of the slot 27 in disc 3 places the two locking discs 2 and 3 in any random position, along with code disc 23.

To unlock the lock thus coded and jammed, all the elements are firstly returned into their initial positions by turning the knob 22 clockwise up to abutment of the elements as described above. The dial 20 is then placed on the shaft 19, the pinions 15 and 18 being able to be returned automatically to their initial position shown in FIG. 1 by the dial spring (not shown) and therefore being located in that position. The fixed finger stop 20*a* (FIG. 1) may be positioned on the door at the same time as the dial or may be permanently fixed thereon, in order to limit the stroke of the dial to the code number selected.

Figure 6A:
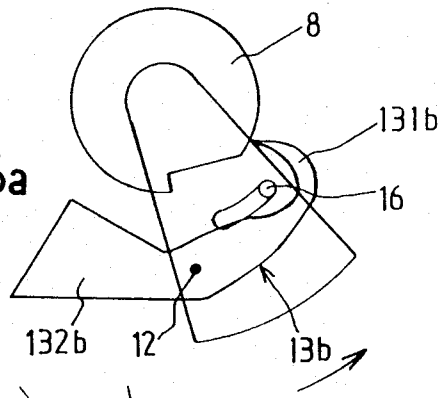
Figure 6B:
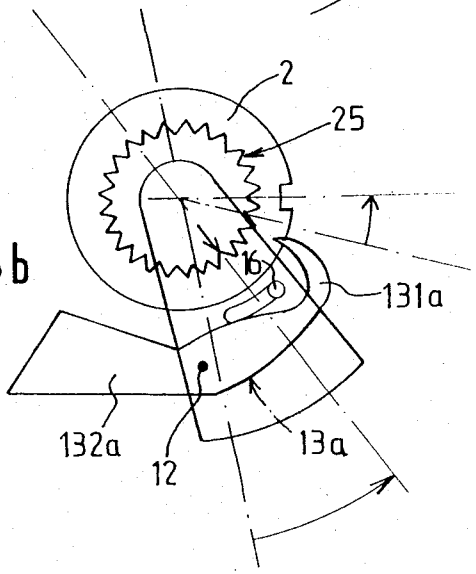
Figure 5A:
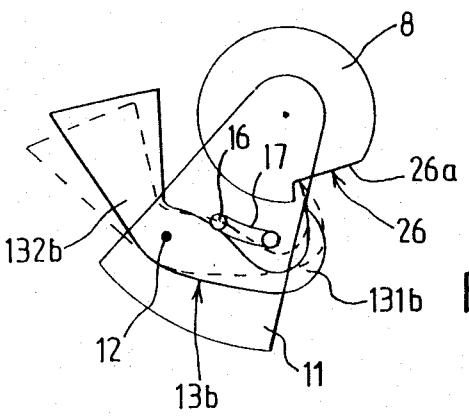
Figure 5B:
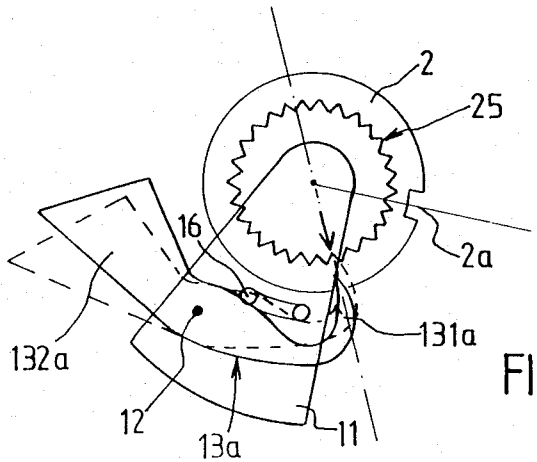

According to the example mentioned above, the code number 7 is dialed first. Clockwise rotation of the dial 20 rotates the pinion 18 and opposite and reduced rotation of pinion 15. At the beginning of counter clockwise rotation of the pinion 15, the finger 16 which is coupled thereto moves in the slot 17 without driving the web 11. The pawls 13 and 14 have their edges in abutment on the finger 16 so shaped that the initial movement of the finger 16 allows the tooth ends of pawl 13 to drop into the recess 26 of the fixed web 8, as shown in dotted lines in FIG. 5*a*, and into a hollow in the toothing 25, as shown in dotted lines in FIG. 5*b*, and the tooth end 141 of the pawl 14 to drop into the initial notch 38 of the disc 23, as shown in dotted lines in FIG. 5*c*. The finger 16 arriving at the end of the slot 17 in the web 11 then drives the latter over an angular sector corresponding to the code member 7. In this movement, the pawl 13 drives the disc 2 counter clockwise until the cam surface 26*a* disengages the pawl 13 from toothing 25 as shown in FIGS. 6*a* and 6*b*. Such angular displacement of disc 2 will correspond to the value, i.e. circumferential extent, of one tooth 25. The pawl 14, being housed in reference notch 38, has its finger 29 located outside the path of finger 28 of the disc 3, which thus does not move, as shown in FIG. 7*a*. It will have been noted that the initial position of disc 3 is its unlocking position where notch 3*a* is aligned with path 4.

During angular movement of the web 11 corresponding to the initial code member 7, the pawl 14 drives the code disc 23 an angular distance corresponding to seven divisions 37. After the operator's finger thus engages the stop 20*a*, the dial 20 is returned to its initial position, i.e. either manually or automatically, and returns therewith the assembly 10. In its initial returning movement the finger 16 first lifts the tooth ends of the pawls 13 and 14 out of engagement with their respective discs of 12 and 23 and then revolves them back to their initial positions. During such return movement, the angular displacement of pawl 14 corresponds to seven divisions 37 of the disc 23 so that in the initial position to which it has returned the tooth end 141 of pawl 14 will be opposite the next code notch in the disc 23 and can engage therein and move the disc an angular distance corresponding to the next code number dialed.

Upon return of the dial (either automatically or manually), the finger 16 first moves through the slot 17 in the opposite direction, i.e. clockwise, and lifts the pawls 13 and 14 before the latter are returned by movement of the web 11. Any striking noise which would enable the stroke made to be "counted" is thus avoided.

The following digit of the code is then dialed (8 for the above example). The pawl 13, after having dropped again, will cause the toothing 25 and disc 2 to progress by one more tooth 25, while pawl 14, dropping in the next code notch, does not change the position of the disc 3 while driving the disc 23 the next angular distance dialed, e.g. 8.

The successive dialing of the ten digits of the code finally places the notch 2*a* in the path 4 of the tool 40 for actuating the lock mechanism 60 as described heretofore.

If the wrong digit is dialed, the pawl 14 cannot drop into a notch in the disc 23, but on a non-notched part of the disc (which may for example be toothed or smooth). In this case, the finger 29 interferes with the finger 28 on the disc 3 and drives the latter out of its unlocking position. The lock is then impossible to unlock without a return of the elements into their initial positions. In addition, this rotation of the disc 3 causes the sensor of the display or alarm member 35 to drop along the cam surface 34. In this way, either a mechanical indicator device indicates a fruitless attempt to open the door, or an alarm is triggered off in the premises or in remote monitoring premises.

Similarly, the dialing of a code comprising an insufficient or an excessive number of digits places the slot 2*a* of disc 2 in a position prohibiting access of the tool 40 to the locking mechanism 60.

In order to obtain such access, several conditions must therefore be complied with, namely:

the number of digits of the code, the value of these digits, the order of these digits.

If just one of these conditions is not complied with, access to the locking mechanism 60 is impossible. It should be noted that the device makes it possible to produce a very large number of combinations, without their being possible to codify. For example, the FIG. 8 may be easily dialed ten times. In the case of a disc 23 with sixty divisions, a code of 10 digits can be programmed only insofar as the addition of the numbers of these digits does not exceed 60 (and even a little less if it is desired to take into account the distance separating the ends 27*a* and 27*b* of the slot 27 which is traversed by the finger 30). Thus the lock according to the invention possesses a limit in the choice of the digits of the code (the sum thereof at the most equal to the number of the divisions), but this limit does not appear to the manipulator seeking to find the code. In other words, the lock of the invention makes it possible to hide a coded combination in a multitude of combinations of which one part might have existed but of which the other cannot exist by reconstruction.

Numerous variants may be made to the embodiment described above. Mention will be made only of that consisting in separating into two connectable members on the one hand the notched code disc proper and on the other hand an adjacent toothed wheel fixedly mounted on the shaft 21, this for reasons of robustness, particularly concerning the action of the pawl and the return into initial position of the device which would be taken up by a separate toothed wheel. In this case, the pawl 14 would be identical to pawl 13, acting only on said toothed wheel, but would be backed by a sensor lever of which one end would cooperate with the code disc and its notches while another end would bear the finger 29 for controlling the position of the disc 2.

Another variant embodiment of the invention consists in providing, instead of disc 2, a locking disc connected to the notched code disc and a locking member which is actuated by a lever of the pawl 14 type if a dialed digit is erroneous, knowing that the locking disc connected to the notched code disc could be in unlocking position if the total of the digits dialed were equal to the total of the digits of the code.

The invention is advantageously applicable in the field of security devices.

What is claimed is:

1. A combination lock having interchangeable coded combinations comprising:

a fixed shaft;

at least two locking members mounted for braked rotation on said shaft and preventing, in all their angular positions, free access of a tool for actuating a lock mechanism except one position obtained after having reproduced the coded combination;

a code disc removably mounted for braked rotation to said shaft and having a reference notch and code notches at predetermined locations in the periphery thereof;

an assembly oscillatable about said shaft; and means for repeatedly oscillating said assembly from an initial position, with the angular amplitude of each oscillator corresponding to the numeric value of a digit of a code;

said assembly including:

a first pawl cooperating with teeth on a first of said members to rotate the latter in one direction from an initial locking position, on each oscillation of said assembly, a constant angular distance independent of the amplitude of each oscillation; and a second pawl cooperating with both said second member and the notches in said code disc to rotate the latter in one direction from an initial position, on each oscillation of said assembly, an angular distance equal to the amplitude of each oscillation and to rotate said second member from an initial position if said second pawl is not engaged in a notch of said disc.

2. The lock of claim 1, wherein the said code disc is made of a material in which code notches can easily be made at least on its periphery which is provided with a marking dividing it into a plurality of equal sectors whose width corresponds to the width of the code notches to be made.

3. The lock of claim 2, wherein said code disc is coupled in rotation with the end of a spindle rotating in braked manner inside said shaft and of which the other end comprises a maneuvering knob for locking the mechanism by jamming the combination and returning the locking member and code disc into initial positions.

4. The lock of claim 3 including:

a fixed stop;

a finger on the first member cooperating with said stop to define the initial position of said first member, and wherein:

said code disc possesses a finger cooperating with a slot in the second member and another finger on said first member for mutual return thereof by means of the maneuvering knob.

5. The lock of claim 1, wherein said first member is, in its initial locking position, remote from its access-permitting position by an angular distance equal to the said constant distance multiplied by the number of digits constituting the coded combination, while the second member is, in its initial position, in its access-permitting position.

6. The lock of claim 1, wherein said oscillating means comprises a drive shaft having an end capable of receiving, in removable manner, an alpha-numeric dial for oscillating said drive shaft with amplitudes corresponding to the numeric value dialed.

7. The lock of claim 6, wherein said assembly comprises a pinion mounted to rotate on said fixed shaft meshing with a pinion on said drive shaft and provided with a finger parallel to said fixed shaft for driving a web, rotating on said fixed shaft, and bearing a pivot for said pawls, said finger passing through a slot in said web and constituting a cam for lifting or lowering said pawls out of or into engagement with the said teeth or the disc notches.

8. The lock of claim 1, wherein the notched disc possesses teeth between the notches and the second pawl has opposite ends, the tooth being on one end and cooperating with said teeth or said notches and the other end of said second pawl having a finger which cooperates with a finger on the second locking member to rotate it when said tooth is engaged in said teeth.

9. The lock of claim 1 including magnetic washers fixed on the fixed shaft and abutting the locking members to brake their rotation.

10. The bolt of claim 1 including a monitor device actuated by the second locking member to detect incorrect reproduction of the correct coded combination.

* * * * *